United States Patent [19]

Tolstopyatov et al.

[11] 4,407,095

[45] Oct. 4, 1983

[54] DEVICE FOR ABRASIVE CLEANING OF BLANKS SHAPED AS BODIES OF REVOLUTION

[76] Inventors: Konstantin S. Tolstopyatov, ulitsa Pervomaiskaya, 30, kv. 24, Elektrostal Moskovskoi oblasti; Anatoly A. Lukyanov, ulitsa Rogozhskaya, 100b, Noginsk Moskovsoi oblasti; Alexandr L. Pyatibrat, ulitsa Mayakovskogo, 13, kv. 16, Elektrostal Moskovskoi oblasti; Igor S. Pryanishnikov, ulitsa Nikolaeva, 23, kv. 44, Elektrostal Moskovskoi oblasti; Gennady N. Maslov, ulitsa Pervomaiskaya, 34/19, kv. 25, Elektrostal Moskovskoi oblasti; Nikolai G. Bobovnikov, ulitsa Sovetskaya, 1, kv. 43, Elektrostal Moskovskoi oblasti; Petr V. Gubin, ulitsa Nikolaeva, 23, kv. 20, Elektrostal Moskovskoi oblasti; Viktor I. Burmakin, ulitsa Stalevarov, 5, kv. 2, Elektrostal Moskovskoi oblasti; Nikolai B. Marchenkov, ulitsa Yalagina, 22, kv. 37, Elektrostal Moskovskoi oblasti; Alexandr F. Chirkin, ulitsa Stalevarov, 8a, kv. 50, Elektrostal Moskovskoi oblasti; Mikhail U. Zemtsov, ulitsa Delegatskaya, 9, kv. 110, Moscow; Ernst L. Tonaevsky, ulitsa Sovetskaya, 64, kv. 9, Noginsk Moskovskoi oblasti, all of U.S.S.R.

[21] Appl. No.: 253,519

[22] PCT Filed: Aug. 14, 1979

[86] PCT No.: PCT/SU79/00066

§ 371 Date: Apr. 14, 1981

§ 102(e) Date: Mar. 31, 1981

[87] PCT Pub. No.: WO81/00534

PCT Pub. Date: Mar. 5, 1981

[51] Int. Cl.[3] ..... B24B 5/04

[52] U.S. Cl. ..... 51/112; 51/123 R; 51/131.1; 51/237 R

[58] Field of Search ..... 51/50 R, 42, 89, 95 WH, 51/103 C, 105 R, 105 SP, 118, 131.1, 216 T, 237 R, 237 CS, 123 R, 80 A, 110, 112; 82/20; 409/165, 167

[56] References Cited

U.S. PATENT DOCUMENTS

| | | | |
|---|---|---|---|
| 790,705 | 5/1905 | Schrader | 51/237 R |
| 1,011,478 | 12/1911 | Olsen | 51/50 R |
| 2,072,970 | 3/1937 | Thom | 51/237 R |
| 3,066,456 | 12/1962 | Ramge | 51/237 R |
| 3,105,288 | 10/1963 | Johnson | 51/105 R |
| 3,779,109 | 12/1973 | Gibert | 82/20 |

*Primary Examiner*—Harold D. Whitehead
*Assistant Examiner*—K. Bradford Adolphson
*Attorney, Agent, or Firm*—Steinberg & Raskin

[57] ABSTRACT

A device for abrasive cleaning of blanks shaped as bodies of revolution is intended to be used in the shops of metallurgical and engineering works for rough grinding of external surface of blanks. The device comprises two wheelheads with rotating tools (7), a movable table (2), a headstock (3) and a footstock (4), carrying centers (5) for the blank, and a blank rotation drive (17). On the table (2) there are mounted a stand (13) and the footstock (4) interconnected by two guides (15) disposed in a vertical plane passing through the line of the centers (5). The headstock (3) is mounted on the guides (15) to be displaced along them.

3 Claims, 2 Drawing Figures

DEVICE FOR ABRASIVE CLEANING OF BLANKS SHAPED AS BODIES OF REVOLUTION

TECHNICAL FIELD

The present invention relates to machine-tool industry, and more particularly it concerns devices for abrasive cleaning of blanks shaped as bodies of revolution, for example, ingots, electrodes, forgings and the like, having cylinrical, taper and barrel shape.

BACKGROUND ART

At present widely known in the art are snagging grinders used for cleaning blanks (see, for example, N. I. Sheftel et al. "Otdelka sortovogo prokata" /Finishing of Sections/, Moscow, Metallurgia Publishers, 1974, p. 131).

The grinder comprises a wheelhead whose spindle mounts a rotating tool, viz., an abrasive wheel, and a table movably mounted on horizontal guides of a bed. Installed on the table are steady and movable stands having rollers to receive a blank. The rollers of the front stand are coupled through a reduction gear with a drive imparting a rotary motion to the blank. The movable stand makes a set-up movement depending on the blank length. The table is given a longitudinal feed from hydraulic cylinders.

However, such grinder cannot be used for simultaneous working of a blank with two wheelheads due to its design. Moreover, as the blank is positioned on the rollers the reliable transmission of rotation to the blank is not ensured due to its slipping and the pressure of the tool on the blank is limited in the process of machining, which decreases the quality of cleaning of the blank and the grinder capacity.

There is also known a cylindrical grinder (see, for example, N. S. Acherkan, "Metallorezhuschie stanki" /Metal-Cutting Machine Tools/, Moscow, Metallurgia Publishers, 1965, V. I, pp. 227–232).

Grinding on this grinder is performed with an abrasive wheel the axis of which is positioned parallel or at an angle to the axis of the blank, the wheel is given a continuous rotary motion and a periodic translational motion in the direction perpendicular to its axis, whereas the blank mounted on centers of the headstock and footstock is given a feed motion. However, only one tool can be used on this grinder to make work, which limits labour productivity.

DISCLOSURE OF THE INVENTION

The present invention is essentially aimed at providing a device for abrasive cleaning of blanks shaped as bodies of revolution, in which a headstock would be installed so as to allow two oppositely disposed wheelheads to be simultaneously brought to the blank, thereby radically increasing the machining efficiency.

This is achieved by a device for abrasive cleaning of blanks shaped as bodies of revolution, comprising a wheelhead with a rotating tool, a movable table mounting a headstock and a footstock carrying centers for a blank, and a blank rotation drive, according to the invention a second wheelhead is mounted opposite to the first wheelhead, and the table is provided with a steady stand and two guides disposed in a vertical plane passing through the line of centers and rigidly connected with the footstock and the stand, the headstock being mounted on the guides and adapted to move along them.

It is expedient that the stand mount hydraulic cylinders whose rods are connected with the headstock.

The employment of the stand and two guides rigidly connected with the footstock makes it possible to have the axis of the centers located high above the table and in such a way as to provide space for arrangement of two large diameter wheelheads with a powerful drive. An increase in the diameter of the tool prolongs the service life thereof, i.e., the time of its continuous operation. An increase in the power of the grinding wheel drive improves the wheel metal removing capacity. Besides, the use of two guides allows the structure of the footstock to have a narrower width, which enables blanks of small diameter to be machined.

The use of the movable headstock makes it possible to clamp blanks of different length with an effort sufficient for transmitting the torque and to get rid of other holding means blocking the passage for the tools.

The invention is also characterized by the fact that the table, in the middle portion thereof, has a port to dispose of the metal removed in the process of machining the blank.

Therefore, the device of the invention due to changes in the design allows a blank to be cleaned during one pass.

BRIEF DESCRIPTION OF THE DRAWINGS

The invention will now be described in greater detail with reference to a specific embodiment thereof in conjunction with the accompanying drawings in which.

BEST MODE FOR CARRYING OUT THE INVENTION

Figure 1:
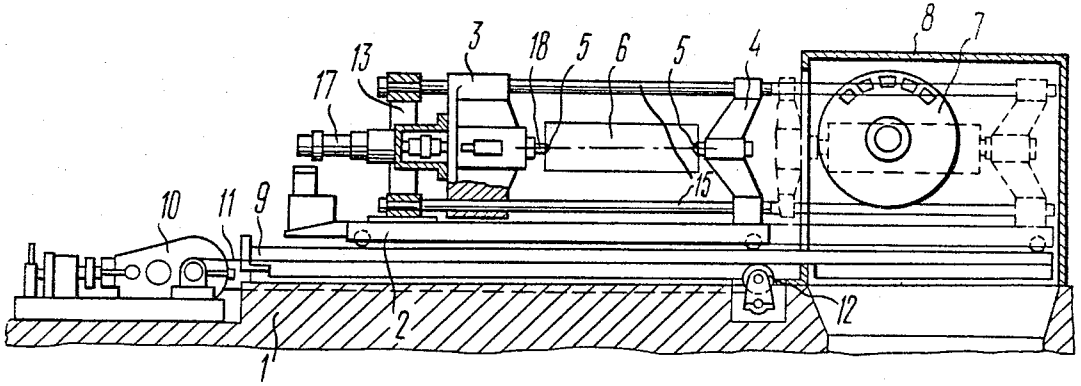
FIG. 1 is a diagrammatic side view of a device for abrasive cleaning of blanks shaped as bodies of revolution.

A device for abrasive cleaning of blanks shaped as bodies of revolution comprises a bed 1 (FIG. 1), a movable table 2, a headstock 3 and a footstock 4 carrying centers 5 for a blank 6, two oppositely-disposed rotating wheelheads with face grinding tools 7 (FIG. 2) introduced into a chamber 8. The axes of rotation of the tools 7 are positioned at an angle symmetrical to the axis of the blank 6 in a horizontal plane.

The bed 1 is provided with horizontal guides 9 along which the table 2 is displaced by means of any prior art drive 10 (FIG. 1) mounted on the bed and connected through a cable 11 with the table, the cable being permanently tensioned by means of a tensioner 12.

Mounted stationary on the table 2 are a stand 13 provided with two hydraulic cylinders 14 (FIG. 2), and the footstock 4.

The footstock 4 and the stand 13 are rigidly connected by two guides 15 (FIG. 1) which mount the headstock 3 adapted to move therealong, the guides 15 being disposed in the vertical plane passing through the line of the centers 5 of the headstock 3 and the footstock 4. To be displaced along the guides 15, the headstock 3 is connected with rods 16 (FIG. 2) of the hydraulic cylinders 14, which cylinders 14 are symmetrically arranged with respect to the line of the centers 5 in the horizontal plane.

Secured on the headstock 3 (FIG. 1) is a drive 17 of any known design for rotating the blank 6. The headstock 3 performs reciprocating motions from the hydraulic cylinders 14 in the process of aligning and clamping the blank. The blanks 6 are clamped with the help of a toothed self-aligning end washer 18 which transmits the torque to the blank without slippage thereof.

Figure 2:
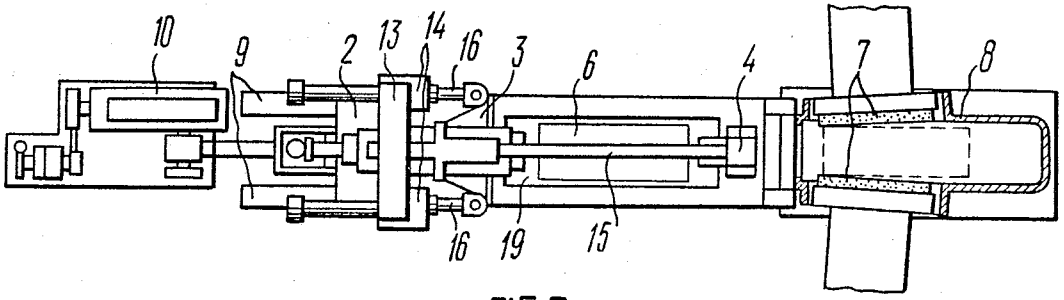
FIG. 2 is a plan view of the same.

The rotating tools 7 of the wheelheads are provided with cross-feed drives which are not shown in FIGS. 1 and 2 to avoid obscuring the drawing; used as such drives may be any prior art drives suitable for the purpose.

In the middle portion of the table 2 there is provided a longitudinal port 19 (FIG. 2) for disposing of metal removed during machining of blanks.

The device of the invention operates as follows.

The blank 6 (FIG. 1) mounted on the centers 5 of the headstock 3 and the footstock 4 is given a rotary motion in the circular feed mode from the drive 17, whereas the table 2 with the blank 6 is fed by means of the drive 10 in the lengthwise direction into the chamber 8 towards the rotating tools 7 which at that moment are spaced apart and are inoperative. When the blank 6 is introduced into the working zone the tools 7 are displaced towards the blank to be resiliently pressed thereto with a preset force. Upon completing the machining (cleaning) of the blank in the known way over the entire length thereof, the tools 7 are returned to the initial position. The table 2 is also returned to the initial position, the headstock 3 by means of the hydraulic cylinders 14 is withdrawn and the machined blank is taken away with the help of any prior art mechanism. After this a next blank is mounted between the centers 5 of the headstock and the footstock and the working cycle is repeated. The blank in FIGS. 1 and 2 and the headstock and the footstock in FIG. 1 are shown in phantom lines in the working zone.

INDUSTRIAL APPLICABILITY

The device for abrasive cleaning of blanks shaped as bodies of revolution is intended to be used in the shops of metallugrical and engineering works for rough grinding of external surfaces of blanks.

We claim:

1. A device for abrasive cleaning of blanks shaped as bodies of revolution, comprising a wheelhead with a rotating tool, a movable table mounting a headstock and a footstock carrying centers for a blank and a blank rotation drive, characterized in that a second wheelhead is mounted opposite to the first wheelhead, and the table is provided with a steady stand and two guides disposed in a vertical plane passing through the line of the centers and rigidly connected with the footstock and the stand, the headstock being mounted on the guides and adapted to move along them.

2. A device as claimed in claim 1, characterized in that the stand mounts hydraulic cylinders whose rods are connected with the headstock.

3. A device as claimed in claim 1, characterized in that the table, in the middle portion thereof, is provided with a longitudinal port.

* * * * *